United States Patent [19]

Rowe

[11] 3,993,386

[45] Nov. 23, 1976

[54] LAMP ENERGY SAVING SPACER

[76] Inventor: Lacy A. Rowe, 1851 Skycoe Drive, Salem, Va. 24153

[22] Filed: Sept. 2, 1975

[21] Appl. No.: 609,607

[52] U.S. Cl. ..... 339/50 R; 240/51.11 A; 339/153

[51] Int. Cl.[2] ..... H01R 33/08

[58] Field of Search ..... 339/50 R, 153–156; 240/51.11 R, 51.11 A, 153

[56] References Cited

UNITED STATES PATENTS

| | | | |
|---|---|---|---|
| 2,346,831 | 4/1944 | Drury | 339/259 R |
| 2,742,619 | 4/1956 | Buquor | 339/50 R |
| 3,137,448 | 6/1964 | Holzhause | 339/154 A |
| 3,582,866 | 6/1971 | Johnson et al. | 339/153 |

FOREIGN PATENTS OR APPLICATIONS

| | | | |
|---|---|---|---|
| 502,069 | 3/1939 | United Kingdom | 339/50 R |

*Primary Examiner*—Roy Lake
*Assistant Examiner*—Neil Abrams

[57] ABSTRACT

An adapter for fluorescent lamps is disclosed which permits fluorescent tubes of lower wattage and shorter length to be installed in lamps and light fixtures which normally require fluorescent tubes of greater wattage and longer length.

10 Claims, 9 Drawing Figures

FIG. 5

LAMP ENERGY SAVING SPACER

This invention relates to an adapter for fluorescent tubes of a given length permitting the fluorescent tubes of the given length to be installed in lamps and light fixtures which normally require fluorescent tubes of greater length.

With the increased need for conservation of energy as a result of diminishing supplies of fossil fuels, and the increasing costs thereof, one energy saving measure which can be utilized is the reduction of the wattage of lamps used in electric lamps and light fixtures. In the case of fixtures for incandescent light bulbs the change of wattage requires simply the substitution of one incandescent bulb of one wattage for one of a different wattage since incandescent bulbs of different wattage have bases of one standard size. Fluorescent lamps and light fixtures normally will accommodate fluorescent tubes of one specific wattage and length. It would be impractical in order to conserve energy by reducing lamp wattage to remove lamps and fixtures which accommodate fluorescent tubes of one wattage, and to substitute lamps and fixtures which will accommodate fluorescent tubes of another wattage.

It is therefore an object of this invention to provide an economical adapter which will permit the exchange of fluorescent tubes of one length and wattage as normally required in installed lamps and lamp fixtures for fluorescent tubes of lower wattage and shorter length for use in the same installed lamp and lamp fixtures.

BRIEF DESCRIPTION OF THE DRAWINGS

With the foregoing objects and features in view and such other objects and features which may become apparent as this specification proceeds, the invention will be understood from the following description taken in conjunction with the accompanying drawing, in which like characters of reference are used to designate like parts and in which.

DETAILED DESCRIPTION OF THE PREFERRED EMBODIMENT

Figures 1, 1A, 1B, 2, 2A, 2B, 3, 4, 5:
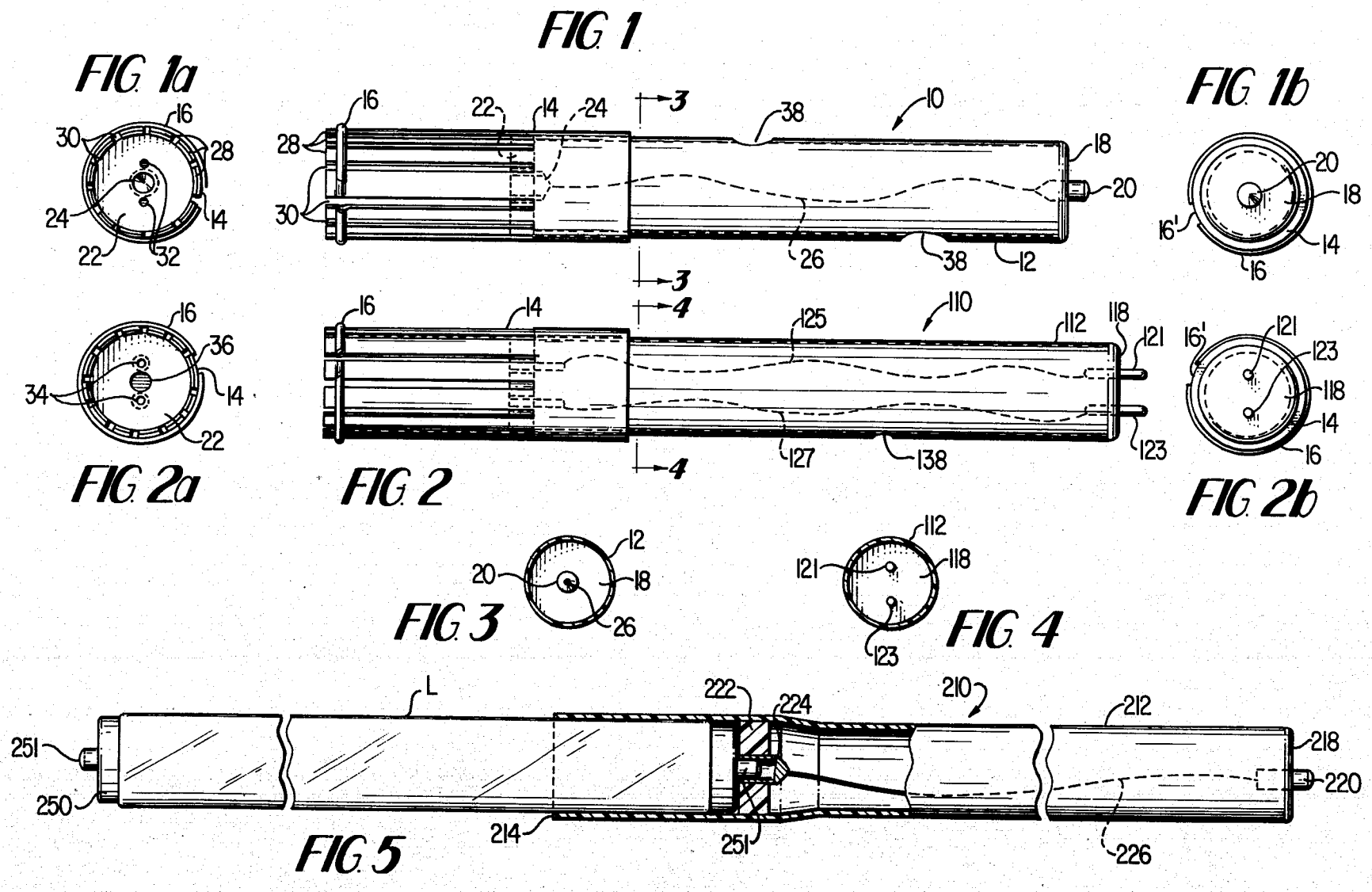
FIG. 1 is an elevational view of a preferred form of the invention designed to fit fluorescent tubes of the one-pin type.
FIG. 1*a* is a left hand end elevational view of the invention shown in FIG. 1.
FIG. 1*b* is a right hand end elevational view of the invention shown in FIG. 1.
FIG. 2 is an elevational view of the invention designed to fit a fluorescent tube of the two-pin type.
FIG. 2*a* is a left hand end elevational view of the invention shown in FIG. 2.
FIG. 2*b* is a right hand end elevational view of the invention shown in FIG. 2.
FIG. 3 is a sectional view taken on line 3—3 of FIG. 1.
FIG. 4 is a sectional view taken on line 4—4 of FIG. 2.
FIG. 5 is an elevational view, partially in section showing a modified form of the invention with a fluorescent tube mounted in the invention.

Referring now to the drawing and particularly to FIGS. 1, 1*a*, 1*b* and 3, one embodiment of the adapter of this invention is indicated by the arrow 10. The adapter 10 comprises an elongated, hollow, cylindrical tube having a closed end portion 12 for mounting in one socket of a double socket fluorescent light fixture, and an open end socket portion 14 for snugly receiving one end of a fluorescent light tube. The open end socket portion 14 and the closed end portion 12 are made as separate cylindrical tubes which are joined together. The open end socket portion 14 has an inside diameter which is substantially equal to the outside diameter of a fluorescent light tube and also is substantially equal to the outside diameter of the closed end portion 12 so that the inner end of the open end socket portion 14 telescopes over the inner end of the closed end portion 12 and is bonded thereon by adhesive means. A transverse partition 22 is secured inside the open end socket portion by adhesive bonding or other suitable means. It serves as a stop to limit the extent to which the open end portion 14 will telescope over the closed end portion 12. The partition 22 has a cylindrical metal socket 24 mounted centrally therein for receiving the contact pin of a single pin type fluorescent light tube. A metal conductor 26 connects the metal contact socket 24 with a metal contact pin 20 which projects centrally from the end wall 18 of the closed end portion 12. The outer end of the open socket portion 14 is separated by a plurality of circumferentially equally spaced slots 30 to form a plurality of longitudinally extending resilient fingers 28 which are integrally connected by the continuous inner end of the open end socket portion 14. A split resilient ring 16 having a gap 16' encompasses the outer end of the open end socket portion 14 and serves to compress the resilient fingers 28 against a fluorescent tube which may be inserted in the open end socket portion 14 and thus to frictionally retain the fluorescent light tube in the open end socket portion 14.

An important advantage of making the adapter 10 from separate tube portions 12 and 14 which are telescoped and joined together is the reduction of the inventory of parts needed to fabricate multiple adapters of different sizes and for use with single pin and bi-pin type fluorescent light tubes. The open end socket portion 14, with the transverse partition 22 therein, can be made so that it may be combined with closed end portions of different lengths and different pin types. The length of the open end socket portion 14 will be of a standard length for different adapters and the partition 22 will be made with a central hole 36 and offset holes 32 therein so that it can easily be fitted with either a centrally located pin receiving metal socket 24 as shown in FIG. 1*a* leaving holes 32 empty, or it can be fitted with a pair of pin receiving metal sockets 34, 34 leaving the central hole 36 vacant as shown in FIG. 2*a*.

The adapter 110 shown in FIGS. 2, 2*a*, 2*b* and 4 is for use with a bi-pin type fluorescent light tube. It differs from the adapter 10 only in length and the number of electrical contacts provided. The closed end portion 112 like the closed end portion 12 of FIG. 1 has an end wall 118 and its inner end is telescoped inside of the inner end of an open end socket portion 14. The transverse partition 22 has two metal pin receiving sockets 34 mounted therein for receiving the metal pin contacts of a bi-pin fluorescent light tube. A pair of conductors 125 and 127 connect the sockets 34, 34 with a pair of metal pins 121 and 123 respectively mounted in the end wall 118 and projecting therefrom. Vent holes 38 and 138 are provided in the closed end portions 12 and 112 of the adapters 10 and 110 respectively to permit circulation of air and prevent over heating of the adapters.

The adapter 212 (shown in FIG. 5) is made from a single piece plastic tube and includes a closed end portion 212 provided with an end wall 218 in which is mounted a metal pin contact 220 and an open end portion 214 which has an inside diameter substantially equal to the outside diameter of the fluorescent light tube L shown mounted therein. A transverse partition 222 is secured inside of the inner end of the open end socket portion 214 by adhesive bonding means. A metal pin receiving socket 224 is mounted centrally in the transverse partition 222 and it is connected by conductor 226 with the pin contact 220 projecting from the end wall 218 of the closed end portion 212. The fluorescent light tube L has plastic end caps 250 at its opposite ends through which extend the metal contact pins 251 mounted centrally therein. The inner end of light tube L which is frictionally retained by the open end socket portion 214 has its contact pin 251 telescoped inside the metal receptacle 251.

The overall length of the adapter 210 and light tube L from pin 220 to pin 251 at the opposite end of the light from pin 220 is equal to the length a fluorescent tube which a certain fluorescent light fixture normally requires. By using the adapters of this invention it will be apparent that fluorescent light tubes of reduced wattage and correspondingly reduced length can be used in any given fluorescent light fixture to replace the fluorescent light tube of size and wattage normally required. By reducing the wattage of the lamp within practical limits a saving of electrical energy can be made.

The adapters of this invention are preferably made of plastic material and at least the open end socket portions 14 and 214 are made of transparent plastic so that the light from the portion of the fluorescent tube inserted in the open end socket portion may be transmitted through the adapter. The transverse partition 22 and the end walls 18, 118 and 218 are preferably made of an electrical non-conductive material, such as synthetic resin-non-conductive plastic.

While in the foregoing there has been described and shown a preferred embodiment of the invention, various modifications and equivalents may be resorted to within the spirit and scope of the invention as claimed.

What is claimed is:

1. An adapter for use with a fluorescent light tube of a predetermined length to permit the fluorescent light tube to be installed in a fluorescent light fixture having spaced sockets therein which normally require a fluorescent light tube of greater length than said predetermined length of the fluorescent light tube to span the distance between said sockets, said adapter comprising an elongated hollow tube having a closed end portion for mounting in one socket of a fluorescent light fixture and an open end socket portion for snugly and slidably receiving one end of said fluorescent light tube, a transverse partition secured within said elongated hollow tube intermediate the ends thereof, spaced therefrom and separating said open end portion and said closed end portion, said partition having contact means mounted therein for making electrical contact with contact means on one end of a fluorescent light tube when said one end of the fluorescent light tube is inserted in said open end socket portion, said closed end portion having an end wall with contact means mounted therein, said contact means in said end wall being duplicative of and adpated for reception and electrical connection in the same socket as the contact means at said one end of said fluorescent light tube, and conductor means passing through a region of space between said partition and said end wall and connecting the contact means in said transverse partition with the contact means in said end wall.

2. The adapter according to claim 1 wherein said open end socket portion includes a plurality of circumferentially spaced, longitudinal spring fingers extending oppositely from said closed end portion, and a resilient ring compressing said open end socket portion adjacent the outer end of said spring fingers.

3. The adapter according to claim 1 wherein said closed end portion has at least one vent hole therein.

4. The adapter according to claim 1 wherein said hollow elongated tube is made of one piece and said open end socket portion has an inside diameter substantially equal to the outside diameter of said fluorescent light tube so as to snuggly fit over one end of said fluorescent light tube.

5. The adapter according to claim 4 wherein said hollow elongated tube is made of transparent plastic material.

6. The adapter according to claim 4 wherein said transverse partition is made of an electrical non-conductive material.

7. An adapter for use with a fluorescent light tube of a predetermined length to permit the fluorescent light tube to be installed in a fluorescent light fixture having spaced sockets therein which normally require a fluorescent light tube of greater length than said predetermined length of the fluorescent light tube to span the distance between said sockets, said adapter comprising an elongated hollow tube having a closed end portion for mounting in one socket of a fluorescent light fixture and an open end socket portion for snugly receiving one end of said fluorescent light tube, a transverse partition secured within said elongated hollow tube separating said open end portion and said closed end portion, said partition having contact means mounted therein for making electrical contact with contact means on one end of a fluorescent light tube when said one end of the fluorescent light tube is inserted in said open end socket portion, said closed end portion having an end wall with contact means mounted therein, said contact means in said end wall being duplicative of the contact means at one end of said fluorescent light tube, and conductor means connecting the contact means in said transverse partition with the contact means in said end wall, said open end socket portion including a plurality of circumferentially spaced, longitudinal spring fingers extending oppositely from said closed end portion, and a resilient ring compressing said open end socket portion adjacent the outer end of said spring fingers, said open end socket portion and said closed end portions being made as separate tubes which are joined together, said open end socket portions having an inside diameter substantially equal to the outside diameter of said closed end portion and having an inner end telescoped over an inner end of said closed end portion, said transverse partition being secured in said open end socket portion and serving as a stop limiting the extent to which said open end socket portion can telescope over said closed end portion, said telescoped inner end of said socket portion being bonded to the inner end of said closed end portion.

8. The adapter according to claim 7 wherein said open end socket portion is made of transparent plastic.

9. The adapter according to claim 7 wherein said contact means in said transverse partition comprises a cylindrical metal socket for receiving the end pin of a single pin type fluorescent tube, said contact means in said end wall of said closed end portion being a cylindrical metal pin.

10. The adapter according to claim 7 wherein said contact means in said transverse partition comprises a pair of spaced cylindrical metal sockets for receiving the end pins of a bi-pin type fluorescent tube, and said contact means in said end wall of said closed end portion being a pair of spaced cylindrical metal pins.

* * * * *